US009828841B2

(12) United States Patent
Kerr

(10) Patent No.: US 9,828,841 B2
(45) Date of Patent: Nov. 28, 2017

(54) SAGDOX GEOMETRY

(75) Inventor: Richard Kelso Kerr, Calgary (CA)

(73) Assignee: NEXEN ENERGY ULC, Alberta (CA)

( * ) Notice: Subject to any disclaimer, the term of this patent is extended or adjusted under 35 U.S.C. 154(b) by 183 days.

(21) Appl. No.: 13/543,012

(22) Filed: Jul. 6, 2012

(65) Prior Publication Data

US 2013/0175031 A1 Jul. 11, 2013

Related U.S. Application Data

(60) Provisional application No. 61/507,196, filed on Jul. 13, 2011.

(51) Int. Cl.
*E21B 43/24* (2006.01)
*F22B 3/00* (2006.01)

(52) U.S. Cl.
CPC ..... *E21B 43/2406* (2013.01); *E21B 43/2408* (2013.01); *F22B 3/00* (2013.01)

(58) Field of Classification Search
CPC ... E21B 43/24; E21B 43/2408; E21B 43/2406
USPC ..... 166/256, 258, 265, 266, 268, 272.3, 166/272.7, 401, 272.2
See application file for complete search history.

(56) References Cited

U.S. PATENT DOCUMENTS 3,976,137 A 8/1976 Bousaid
4,099,566 A * 7/1978 Redford ..... E21B 43/243 166/260
4,127,172 A * 11/1978 Redford et al. ..... 166/261
4,217,956 A 8/1980 Goss et al.
4,265,310 A 5/1981 Britton et al.
4,427,066 A 1/1984 Cook
4,573,530 A 3/1986 Audeh et al.
4,682,652 A 7/1987 Huang et al.
4,860,827 A 8/1989 Lee et al.
5,407,009 A 4/1995 Butler et al.
5,456,315 A 10/1995 Kisman et al.
5,626,193 A 5/1997 Nzekwu et al.
6,015,015 A 1/2000 Luft et al.
6,412,557 B1 7/2002 Ayasse et al.
(Continued)

FOREIGN PATENT DOCUMENTS

CA 2559117 A1 1/2008
CA 2650130 A1 7/2009
(Continued)

OTHER PUBLICATIONS

Adams et al., "Controls on the Variability of Fluid Properties of Heavy Oils and Bitumen in Foreland Basin: A Case History From the Albertan Oil Sands", Search & Discovery Article #40275, Mar. 10, 2008.

(Continued)

*Primary Examiner* — Silvana Runyan
(74) *Attorney, Agent, or Firm* — Norton Rose Fulbright Canada LLP; Paul J. Field

(57) ABSTRACT

There is provided a process to recover bitumen from a subterranean hydrocarbon reservoir. The process includes injecting steam and oxygen separately into the bitumen reservoir. When mixed in the reservoir, the mix is in the range of 5 to 50% $O_2$. The process also includes producing hot bitumen and water using a horizontal production well, and producing/removing non-condensable combustion gases to control reservoir pressure.

6 Claims, 6 Drawing Sheets

Preferred Well Configuration

(56) References Cited

U.S. PATENT DOCUMENTS

| | | | | |
|---|---|---|---|---|
| 7,581,587 | B2 | 9/2009 | Pfefferle | |
| 7,740,062 | B2 | 6/2010 | Lim et al. | |
| 7,780,152 | B2 | 8/2010 | Rao | |
| 7,882,893 | B2 | 2/2011 | Fraim | |
| 7,900,701 | B2 | 3/2011 | Weiers et al. | |
| 8,210,259 | B2 | 7/2012 | De Francesco | |
| 2005/0045332 | A1 | 3/2005 | Howard et al. | |
| 2005/0211434 | A1* | 9/2005 | Gates et al. | 166/272.3 |
| 2006/0207762 | A1* | 9/2006 | Ayasse | 166/261 |
| 2006/0213658 | A1 | 9/2006 | Maguire | |
| 2006/0231252 | A1* | 10/2006 | Shaw et al. | 166/272.3 |
| 2007/0187093 | A1* | 8/2007 | Pfefferle | 166/257 |
| 2007/0187094 | A1 | 8/2007 | Pfefferle | |
| 2008/0116694 | A1 | 5/2008 | Hendershot | |
| 2008/0190813 | A1 | 8/2008 | Dana et al. | |
| 2008/0264635 | A1 | 10/2008 | Chhina et al. | |
| 2009/0077515 | A1 | 3/2009 | Sinha et al. | |
| 2009/0188667 | A1 | 7/2009 | Lim et al. | |
| 2009/0200024 | A1* | 8/2009 | Ayasse | E21B 43/243 166/261 |
| 2009/0236092 | A1 | 9/2009 | O'Brien | |
| 2009/0260811 | A1* | 10/2009 | Cui | E21B 36/02 166/272.3 |
| 2009/0272532 | A1 | 11/2009 | Kuhlman | |
| 2009/0288827 | A1 | 11/2009 | Coskuner | |
| 2010/0065268 | A1 | 3/2010 | Gates et al. | |
| 2010/0096126 | A1 | 4/2010 | Sullivan et al. | |
| 2010/0212894 | A1 | 8/2010 | Latimer et al. | |
| 2010/0276148 | A1 | 11/2010 | Wylie et al. | |
| 2012/0247773 | A1 | 10/2012 | Schneider et al. | |
| 2013/0098603 | A1 | 4/2013 | Kerr | |
| 2013/0248177 | A1 | 9/2013 | Kerr | |
| 2013/0284435 | A1 | 10/2013 | Kerr | |
| 2013/0284461 | A1 | 10/2013 | Kerr | |

FOREIGN PATENT DOCUMENTS

| | | | |
|---|---|---|---|
| WO | WO 2006-074555 | A1 | 7/2006 |
| WO | WO 2008-060311 | A2 | 5/2008 |
| WO | WO 2010-092338 | A2 | 8/2010 |
| WO | WO 2010-101647 | A2 | 9/2010 |
| WO | WO 2013-006950 | A2 | 1/2013 |

OTHER PUBLICATIONS

Aherne et al., "Fluid Movement in the SAGD Process: A Review of the Dover Project", Journal of Canadian Petroleum Technology, Jan. 2008.
Akram, "Reservoir Simulation Optimizes SAGD", American Oil & Gas Reporter (AOGR), Sep. 2010.
Alberta Chamber of Resources, "Oil Sands Technology Roadmap", Jan. 30, 2004, p. 27-32.
Alberta Energy, "Gas Over Bitumen Technical Solution—Technical Solution Roadmap", www.energy.alberta.ca, 2011.
Ashrafi et al., "Numerical Simulation Study of SAGD Experiment and Investigating Possibility of Solvent Co-Injection", Society of Petroleum Engineers, Jul. 19-21, 2011.
Asia Industrial Gases Association (AIGA), "Oxygen Pipeline Systems", 2005.
Balog et al., "The Wet Air Oxidation Boiler for Enhanced Oil Recovery", Journal of Canadian Petroleum, Sep.-Oct. 1982, p. 73-79.
Belgrave et al., "SAGF Optimization With Air Injection", Society of Petroleum Engineers, SPE 106901, Apr. 15-18, 2007.
Bennion et al., "The Use of Carbon Dioxide as Enhanced Recovery Agent for Increasing Heavy Oil", Joint Canada/Romania Heavy Oil Symposium, Mar. 3-7, 1993, p. 1-37.
Berkowitz, "Fossil Hydrocarbons", Academic Press, 1997.
Braswell, "New Heavy Oil Solvent Extraction Pilot to Test Experimental Process", Journal of Petroleum Technology Online, Jan. 9, 2012.
Brennan, "Screw Pumps Provide High Efficiency in Transport of Orinoco Bitumen", Pipeline & Gas Journal, vol. 222, Issue 3, Mar. 1995, p. 36-39.
Brigham et al., "In Situ Combustion", Chptr. 16, Reservoir Engineering, May 16, 2005.
Business Wire, "ELAN Energy Announces Nine Months Results", Nov. 1996.
Business Wire, "ELAN Energy Announces Six Months Results", Aug. 1996.
Butler, "Thermal Recovery of Oil and Bitumen", Prentice Hall, 1991, p. 4-15.
Canadian Association of Petroleum Producers (CAPP), "The Facts on Oil Sands", 2010.
Carcoana, "Enhanced Oil Recovery in Rumania", Society of Petroleum Engineers, SPE/DOE 10699, Apr. 4-7, 1982.
Chen et al., "Effects of Reservoir Heterogeneities on Steam-Assisted Gravity-Drainage Process", Society of Petroleum Engineers, V.11, No. 5, Oct. 2008.
Chen, "Assessing and Improving SAGD: Reservoir Homogeneities, Hydraulic Fractures and Mobility Control Foams" Stanford PhD Thesis, May 2009.
Chu, "A Study of Fireflood Field Projects", Journal of Petroleum Technology, Feb. 1977, p. 111-120.
Craig et al., "A Multipilot Evaluation of the COFCAW Process", Journal of Petroleum Technology, Jun. 1974, p. 659-666.
Dang et al., "Investigation of SAGD in Complex Reservoirs", SPE 133849-MS, Society of Petroleum Engineers, 2010.
Das, "Well Bore Hydraulics in a SAGD Well Pair", Society of Petroleum Engineers, 97922-MS, Nov. 1-3, 2005.
Dietz et al., "Wet and Partially Quenched Combustion", Journal of Petroleum Technology, Apr. 1968, p. 411-415.
Donaldson, et al., "Enhanced Oil Recovery II, Process and Operations", Chapter 11, Elsevier, 1989.
Dusseault, "Comparing Venesuelan and Canadian Heavy Oil and Tar Sands", Canadian Inst. Mining (CIM), Jun. 12-14, 2011.
Edmunds et al., "Economic Optimum Operating Pressure for SAGD Projects in Alberta", Journal of Canadian Petroleum Technology, V. 40, Dec. 2001, p. 13-17.
Elliot et al., "Computer Simulation of Single-Well Steam Assisted Gravity Drainage", U.S. Dept. of Energy Contract No. DE-FG22-96BC14994, Jul. 1999.
El-Sayed et al., "Horizontal Well Length: Drill Short or Long Wells?", Society of Petroleum Engineers, Nov. 18-20, 1996, p. 423-431.
Escobar, et al., "Optimization Methodology for Cyclic Steam Injection With Horizontal Wells", Society of Petroleum Engineers, Nov. 6-8, 2000.
Fadillah, "12 Oil Companies to Use EOR Methods to Boost Production", The Jakarta Post, Jun. 4, 2013.
Falk et al, "A Review of Insulated Concentric Coiled Tubing for Single Well, Steam Assisted Gravity Drainage (SWASGD)", Society of Petroleum Engineers, Feb. 26-28, 1996.
Farouq Ali et al., "The Promise and Problems of Enhanced Oil Recovery Methods", Journal of Canadian Petroleum Technology, V. 35, No. 7, Sep. 1996, p. 57-63.
Fatemi et al., "Injection Well-Producer Well Combinations for Toe-to-Heel Steam Flooding (THSF)", Society of Petroleum Engineers, 140703-MS, May 23-26, 2011.
Fatemi et al., "Preliminary considerations on the application of toe-to-heel steam flooding (THSF): Injection well-producer well configurations", Chem. Eng. Res. & Design, V. 8, No. 11, 2011, p. 2365-2379.
Finan et al., "Nuclear Technology & Canadian Oil Sands: Integration of Nuclear Power with In-Situ Oil Extraction", MIT Thesis, Jun. 2007.
Frauenfeld et al., "Effect of an Initial Gas Content on Thermal EOR as Applied to Oil Sands", Journal of Petroleum Technology, Mar. 1988.
Gates et al., "In-Situ Combustion in the Tulare Formation, South Belridge Field, Kern County, California", Journal of Petroleum Technology, May 1978, p. 798-806.
Godin, "Clean Bitumen Technology Action Plan—From Strategy to Action", PTSC Water forum, May 16, 2011.

(56) References Cited

OTHER PUBLICATIONS

Greaves et al., "In Situ Combustion (ISC) Process Using Horizontal Wells", Journal of Canadian Petroleum Technology, vol. 35, No. 4, Apr. 1996, p. 49-55.
Greaves et al., "THAI—New Air Injection Technology", Society of Petroleum Engineers, Report 99-15, Jun. 14-18, 1995.
Green Car Congress, "Chevron Leveraging Information Technology to Optimize Thermal Production of Heavy Oil with Increased Recovery and Reduced Costs", Jun. 23, 2011.
Gutierrez et al., "The Challenge of Predicting Field Performance of Air Injection Projects Based on Laboratory and Numerical Modelling", Journal of Canadian Petroleum Technology, vol. 48, No. 4, Apr. 2009, p. 23-34.
Haggett et al., "Update 3-Long Lake Oil Sands Output May Lag Targets", Reuters, Feb. 10, 2011.
Halliburton, "Zonal Isolation for Steam Injection Applications", www.halliburton.com, 2010.
Hanzlik et al., "Forty Years of Steam Injection in California—The Evolution of Heat Management", Society of Petroleum Engineers, SPE 84848, Oct. 20-21, 2003.
Healing, "Petrobank Technology Earns Zero Grade", Calgary Herald, Mar. 10, 2012.
Heidrick et al., "Oil Sands Research and Development", Alberta Energy Research Inst., Mar. 2006.
Herbeck et al., "Fundamentals of Tertiary Oil Recovery", Energy Publications, 1977.
Herrera et al., "Wellbore Heat Losses in Deep Steam Injection Wells," The Society of Petroleum Engineers Regional Mtg., Apr. 12, 1978.
Hong et al., "Effects of Noncondensable Gas Injection on Oil Recovery by Steamflooding", Journal of Petroleum Technology, Dec. 1984.
Huygen et al., "Wellbore Heat Losses and Leasing Temperatures During Steam Injection", Apr. 1966, p. 25-32.
Improved Recovery Week, "Thermal System Ups Heavy Oil Flow; Lighter Crudes Eligible?", Dec. 4, 1995.
Integra Engineering Ltd., "Pushwater Systems Extend Heavy Oil Collection", 2011.
Ipek et al, "Numerical Study of Shale Issues in SAGD", Canadian Int'l Pet. Conf., Calgary, Jun. 17, 2008.
Jacos, "Jacos Hangingstone Expansion Project", www.jacos.com, Apr. 2010.
Jaremko, "Pressure Communication", Oilweek, Feb. 2006.
Javad et al., "Feasibility of In-Situ Combustion in the SAGD Chamber", Journal of Canadian Petroleum Technology, Jan. 27, 2011, p. 31-44.
Johnson et al., "Production Optimization at Connacher's Pod One (Great Divide) Oil Sands Project", Society of Petroleum Engineers, SPE Report No. 145091-MS, Jul. 19-21, 2011.
Jorshari, "Technology Summary", Journal of Canadian Petroleum Technology, 2011.
Kerr et al., "Sulphr Plant Waste Gasses: Incineration Kinetics and Fuel Consumption", Western Research & Development Ltd., Jul. 1975.
Kisman et al., "Development and Economic Application of Anti-Water Coning Methods to Alleviate a Widespread Problem", 5th Unitar Int'l Conf. on Heavy Crude and Tar Sands, 1991, p. 279-287.
Kristoff et al., Winter Horizontal Well EOR Project, Phase III, Wascana Energy Inc., SRC Pub. No. P-110-436-C-99, Nov. 1999.
Kumar et al., "Cyclic Steaming in Heavy Oil Diatomite", Society of Petroleum Engineers, Mar. 8-10, 1995, p. 109-122.
Lai et al, "Factors Affecting the Application of Anti-Water Coning Technology (AWACT) at the South Jenner Oil Field, Southeast Alberta", Journal of Canadian Petroleum Technology, vol. 38, No. 3, Mar. 1999, p. 25-37.
Lake et al., "A Niche for Enhanced Oil Recovery in the 1990s", Oilfield Rev., Jan. 1992.
Lange, "Handbook of Chemistry", McGraw Hill, 1973.
Leung, "Numerical Evaluation of the Effect of Simultaneous Steam and Carbon Dioxide Injection on the Recovery of Heavy Oil", Society of Petroleum Engineers, Sep. 1983, p. 1591-1599.
Li et al, "Gas-Over-Bitumen Geometry and its SAGD Performance Analysis with Coupled Reservoir Gas Mechanical Simulation", Journal of Canadian Petroleum Technology, Jan. 2007, p. 42-49.
Li et al., "Numerical Investigation of Potential Injection Strategies to Reduce Shale Barrier Impacts on SAGD Process", Journal of Canadian Petroleum Technology, Mar. 2011, p. 57-64.
Liebe et al., Winter Horizontal Well EOR Project, Phase IV, Wascana Energy Inc., SRC Pub. No. P-110-606-C-02, Dec. 2002.
Lowey, "Bitumen Strategy Needs Better Grounding: EUB Study Offers Bad News for Athabasca Gas Producers", Business Edge, V. 4, No. 2, Jan. 15, 2004.
Luft, et al., "Thermal Performance of Insulated Concentric Coiled Tubing (ICCT) for Continuous Steam Injection in Heavy Oil Production.", Society of Petroleum Engineers, 37534-MS, Feb. 10-12, 1997.
Luhning et al., "The AOSTRA Anti Water Coning Technology (AWACT) Process—From Invention to Commercial Application", SPE Paper No. CIM/SPE 90-132, 1990, p. 132.1-132.8.
Luo et al., "Feasibility Study of CO2 Injection for Heavy Oil Reservoir After Cyclic Steam Simulation: Liaohe Oil Field Test", Society of Petroleum Engineers, Nov. 1-3, 2005.
Marufuzzanan, "Solubility and Diffusivity of Carbon Dioxide, Ethane, and Propane in Heavy Oil", University of Regina, M.A.Sc. Thesis, Nov. 2010.
McColl, "Nuclear Energy: Hedging Option for the Oil Sands", Nov. 2, 2006.
Moore et al., "In Situ Combustion Performance in Steam Flooded Heavy Oil Cores", Journal of Canadian Petroleum Technology, vol. 38, No. 13, 1999.
Moore et al., "Parametric Study of Steam Assisted in Situ Combustion", Final Report, vols. 1-2, 1994, p. 1-336.
Nasr, et al., "Thermal Techniques for the Recovery of Heavy Oil Bitumen", Society of Petroleum Engineers, Dec. 5-6, 2005.
New Technology Magazine, "EnCana Plans First Commercial Use of Solvent in New Oilsands Project", Nov. 2009, p. 10.
New Technology Magazine, "Excelsior Files Patent for ISC Process", www.newtechmagazine.com, Sep. 25, 2009.
New Technology Magazine, "Excelsior Searching for Joint Venture Partner for Hangingstone COGD Project", www.newtechmagazine.com, Nov. 20, 2009.
New York Times, Business Wire, "Ranger Oil in $408M Deal for Elan Energy", Sep. 3, 1997.
Nexen Inc., "Nexen Announces Second Quarter Results", Aug. 4, 2011.
N-solv Corporation, "Developing an In Situ Process for the Oilsands", 2012.
Oil & Gas Journal, "Self-Setting Thermal Packers Help Cyclic Steam", www.ogj.com Dec. 14, 1998.
Oil & Gas Journal, "Special Report: More US EORr Projects Start But EOR Production Continues Decline", Apr. 21, 2008.
Oilsands Quest, "Management Presentation", 2011.
Pacheco et al., "Wellbore Heat Losses and Pressure Drop in Steam Injection", The Journal of Petroleum Technology, Feb. 12, 1972, p. 139-144.
Parappilly et al., "SAGD With a Longer Wellbore", Journal of Canadian Petroleum Technology, V. 48, No. 6, Jun. 2009, p. 71-77.
Parrish et al., "Laboratory Study of a Combination of Forward Compustion and Waterflooding—The COFCAW Process", Journal of Petroleum Technology, Jun. 1969, p. 753-761.
Patton et al., "Carbon Dioxide Well Stimulation: Part 1—A Parametric Study", Journal of Petroleum Technology, Aug. 1982, p. 1798-1804.
Piers, "Coping With Water From Oil & Gas Wells", C-FER Technologies, Jun. 14, 2005.
Pooladi-Darvish et al., "SAGD Operations in the Presence of Underlying Gas Cap and Water Layer-Effect of Shale Layers", Journal of Canadian Petroleum Technology, V. 41, No. 6, Jun. 2002.
Prats et al., "In Situ Combustion Away From Thin, Horizontal Gas Channels", Society of Petroleum Engineers Journal, Mar. 1968, p. 18-32.

(56) References Cited

OTHER PUBLICATIONS

Ramey, "In Situ Combustion", Proc. 8th World Pet. Long., 1970, p. 253-262.
Roche, "Beyond Steam", New Technology Magazine, Sep. 2011.
Roche, "No Analogue", New Technology Magazine, Apr. 2009, p. 10.
Ross, "Going the Distance", New Technology Magazine, Dec. 2008, p. 34.
Ross, "Injecting Air Replaces Gas in Depleted Gas Over Bitumen Reservoir", New Technology Magazine, May 2009, p. 34-46.
Saltuklaroglu et al., "Mobil's SAGD Experience at Celtic, Saskatchewan", SPE, 99-25, 1999, p. 45-51.
Sarathi, "In-Situ Combustion Handbook—Principals and Practices", Report Prepared for U.S. Department of Energy, Jan. 1999.
Sarkar et al., "Comparison of Thermal EOR Processes Using Combinations of Vertical and Horizontal Wells", Society of Petroleum Engineers, SPE 25793 Feb. 8-10, 1993, p. 175-181.
Satter, "Heat Losses During Flow of Steam Down a Wellbore", The Journal of Petroleum Technology, Jul. 1965, p. 845-851.
Schindelar et al., Mideast Heavy Oil Pilot Delivers for Chevron, The Daily Oil, Oct. 21, 2010.
Schlumberger Ltd., www.slb.com, "Packer Systems", May 2012.
Shin et al., "Shale Barrier Effects on SAGD Performance", Society of Petroleum Engineers, SPE 125211-MS, Oct. 19-21, 2009.
Shore, "Making the Flare Safe", Journal of Loss Prevention in the Process Industries, V.9, No. 6, 1996, p. 363-381.
Singhal et al., "A Mechanistic Study of Single-Well Steam Assisted Gravity Drainage", SPE, 59333-MS, Apr. 3-5, 2000.
Stalder, "Cross-SAGD (XSAGD)—An Accelerated Bitumen Recovery Alternative", Society of Petroleum Engineers, V. 10, No. 1, Nov. 1-3, 2005.
Stevens et al., "A Versatile Model for Evaluating Thermal EOR Production Economics", Society of Petroleum Engineers, No. 1998. 113, 1998.
Stockwell et al., "Transoil Technology for Heavy Oil Transportation: Results of Field Trials at Wolf Lake", Society of Petroleum Engineers, 1988, p. 248-258.
Stone et al., "Flares", Chptr. 7, www.gasflare.org, Dec. 1995, p. 7.1-7.44.
Stone et al., "Flares", Chptr. 7, www.gasflare.org, Dec. 2012, p. 7.1-7.44.
Tan et al., "Application of a Thermal Simulator with Fully Coupled Discretized Wellbore Simulation to SAGD", Journal of Canadian Petroleum Technology, vol. 41, No. 1, 2002, p. 25-30.
Tavallali, "Assessment of SAGD Well Configuration Optimization in Lloydminster Heavy Oil Reserve", Society of Petroleum Engineers, SPE 153128, Mar. 20-22, 2012.
Thimm et al., "A Statistical Analysis of the Early Peace River Thermal Project Performance", Journal of Canadian Petroleum Technology, V. 32, No. 1, Jan. 1993.
Thomas, "Enhanced Oil Recovery—An Overview", Oil & Gas Science & Technology, V. 63, No. 1, 208, p. 9-19.
Triangle Three Engineering, "Technical Audit Report—Gas Over Bitumen Technical Solutions", 2010.
Turta et al., "Preliminary Considerations on Application of Steamflooding in a Toe-to-Heel Configuration", 130444-PA, Journal of Canadian Petroleum Technology, V. 48, No. 11, Nov. 2009.
U.S. Department of Energy, "Enhanced Geothermal Systems—Wellfield Construction Workshop", San Francisco, Oct. 16, 2007.
U.S. Environmental Protection Agency, "Industrial Flares", www.epa.gov/ttn/chief/ap42/ch13/final/c13s05.pdf, Jun. 2012.
Vanderklippe, "Long Lake Project Hits Sticky Patch", The Globe and Mail, Feb. 10, 2011.
Walley, Middle East Enhanced Oil Recovery, www.arabianoilandgas.com, May 5, 2011.
Wikipedia, "Orimulsion", 2013.
Willhite et al., "Wellbore Refluxing in Steam Injection Wells", Journal of Petroleum Technology, Mar. 1987 p. 353-362.
www.lloydministerheavyoil.com, "Completions and Workovers", 2012.
Xinhua's China Economic Information Service, "China's First Orimulsion Pipeline Comes on Steam", Nov. 7, 2006.
Yang et al., "Combustion Kinetics of Athabasca Bitumen From ID Combustion Tube Experiments", Int'l Assoc. for Mathematical Geology, Sep. 2009, p. 193-211.
Yang et al., "Design and Optimization of Hybrid Ex Situ / In Situ Steam Generation Recovery Processes for Heavy Oil and Bitumen", Canadian Heavy Oil Association, SPE 117643, Oct. 20-23, 2008.
Yang et al., "Design of Hybrid Steam—In Situ Combustion Bitumen Recovery Process", 2009, p. 213-223.
Yang et al., "The Design of Hybrid Steam-In Situ Combustion Bitumen Recovery Processes", Proceedings of the Canadian Int'l Petroleum Conference/SPE Gas Technology Symp. Joint Conference, Paper 2008-114, Jun. 17-19, 2008.
Zawierucha et al., Material Compatibility and Systems Considerations in Thermal EOR Environments Containing High-Pressure Oxygen, Journal of Petroleum Technology, Nov. 1988, p. 1477-1483.
U.S. Appl. No. 13/628,164, filed Sep. 27, 2012.
U.S. Appl. No. 13/888,874, filed May 7, 2013.
U.S. Appl. No. 13/893,902, filed May 14, 2013.
U.S. Appl. No. 13/889,775, filed May 8, 2013.
U.S. Appl. No. 14/582,819, filed Dec. 24, 2014.
U.S. Appl. No. 14/582,819, filed Dec. 24, 2014, Kerr.
Official Action for U.S. Appl. No. 13/628,164, dated Mar. 13, 2014, 7 pages.
Notice of Allowance for U.S. Appl. No. 13/628,164, dated Sep. 26, 2014, 8 pages.
United States Patent and Trademark Office, Office Action dated Feb. 26, 2015, issued in U.S. Appl. No. 14/058,488.
United State Patent and Trademark Office, Office Action dated Mar. 6, 2015, issued in U.S. Appl. No. 14/078,983.
United States Patent and Trademark Office, Office Action dated Apr. 9, 2015, issued in U.S. Appl. No. 13/888,874.
United States Patent and Trademark Office, Office Action dated Apr. 10, 2015, issued in U.S. Appl. No. 13/889,775.
USPTO, Office Action for U.S. Appl. No. 14/083,106 dated Nov. 19, 2015.
USPTO, Office Action for U.S. Appl. No. 13/893,902 dated Sep. 3, 2015.
USPTO, Office Action for U.S. Appl. No. 13/893,902 dated Apr. 21, 2016.
USPTO, Office Action for U.S. Appl. No. 14/104,711 dated Nov. 18, 2015.
USPTO, Office Action for U.S. Appl. No. 14/058,488 dated Nov. 5, 2015.
USPTO, Office Action for U.S. Appl. No. 14/582,819 dated Aug. 11, 2015.
USPTO, Office Action for U.S. Appl. No. 13/928,839 dated Oct. 22, 2015.
USPTO, Office Action for U.S. Appl. No. 13/628,178 dated Aug. 21, 2015.
USPTO, Office Action for U.S. Appl. No. 13/628,178 dated Feb. 23, 2016.
State Intellectual Property Office of China, Office Action for CN Application No. 201280034449.9 dated Oct. 10, 2015.
State Intellectual Property Office of China, Patent Search Report for CN Application No. 201280034449.9 dated Sep. 25, 2015.
State Intellectual Property Office, Second Office Action for CN Application No. 201280034119.9 dated Aug. 8, 2016.

* cited by examiner

SAGDOX GEOMETRY

FIELD OF THE INVENTION

A method and process to conduct SAGDOX EOR of bitumen, by injecting oxygen and steam separately, into a bitumen reservoir; and to remove, as necessary, non-condensable gases produced by combustion, to control the reservoir pressures. In one aspect of the invention a cogeneration operation is locally provided to supply oxygen and steam requirements.

Acronyms Used Herein

SAGD=Steam Assisted Gravity Drainage

SAGDOX=The present invention including SAGD with oxygen gas $SAGDOX_{(x)}$=SAGDOX with x % oxygen ISC=Insitu-Combustion PG=Produced non-condensable Gases GD=Gravity Drainage ETOR=Energy to Oil Ratio (MMBTU/bbl)

EOR=Enhanced Oil Recovery

U of C=University of Calgary

CSS=Cyclic Steam stimulation

ISC ($O_2$)=ISC using oxygen gas

ISC (Air)=ISC using compressed air

STARS=Steam Assisted Recovery Simulation

SI-ISC=SAGD Initiated ISC

VT=vertical

HZ=horizontal

BACKGROUND OF THE INVENTION

The process, used widely for in situ recovery of bitumen in Canada, from the Athabasca or similar deposits, is SAGD.

But, SAGD has the following problems:

Steam is Costly

The process uses a considerable amount of water (0.25 to 0.50 bbl/bbl.bit.) even after recycle of produced water.

$CO_2$ emissions are high (~0.08 tonnes $CO_2$/bbl bitumen).

$CO_2$ emissions are not easily captured (diluted in flue gas).

Steam cannot be economically transported for more than 5 km; so a central steam plant cannot service a wide land area.

Reservoir in-homogeneities (including lean zones) can negatively impact SAGD performance.

Temperature is fixed by operating pressure. T cannot exceed saturated-steam temperatures. If we have to lower pressures, to help contain reservoir fluids, productivity is reduced.

SAGD cannot mobilize connate water by vaporization.

Produced water volumes are less than injected steam volumes, usually.

SAGD cannot reflux steam in the reservoir—it is a once-through steam process.

Well-bore hydraulics can limit effective well lengths to <1000 m using normal well sizes and a 5 m spacing between injector and producer.

SAGD cannot mobilize lean-zone water by vaporization. Lean zones, with reduced bitumen saturation, can block steam chamber growth and impair productivity.

SAGD, in the steam-swept zone, leaves behind residual bitumen (10-25%) that is not recovered.

SAGDOX may be defined herein with respect to the present invention as a SAGD add-on process that utilizes oxygen in addition to the steam used with SAGD and which mixes together to inject energy (heat) to the bitumen.

Oxygen provides additional heat by combusting residual bitumen in a steam-swept zone. A SAGDOX process may be initiated as well without SAGD.

Implementing a SAGDOX process is capable of reduce the overall cost of energy delivered to the bitumen reservoir.

SAGDOX should use less water directly, and produces more water than used when accounting for connate water, combustion water and lean zone water.

$CO_2$ is emitted in a concentrated stream, suitable for sequestration.

If some $CO_2$ is sequestered in the reservoir or sequestered in an off-site location, SAGDOX can emit less $CO_2$ than SAGD.

Oxygen can be economically transported in pipelines for over a 100 miles. We can centralize oxygen production.

A SAGDOX process will not be affected, as much as SAGD, by reservoir in-homogeneities.

In a SAGDOX process, the combustion component of energy delivery creates temperatures higher than saturated-steam T. For a given reservoir or process pressure, SAGDOX will have higher average T than SAGD.

Connate water will be vaporized and mobilized as steam in SAGDOX.

Since average SAGDOX T is greater than saturated steam T, we can reflux some steam in the reservoir.

Per unit production, produced fluid (bitumen+water) volumes are less than SAGD volumes, so we can extend the length of the horizontal production well without exceeding hydraulic limits.

A single well pair for a SAGDOX process can recover more oil than a comparable SAGD well pair.

Lean zone bitumen will be recovered or combusted, lean zone water will be vaporized.

Almost no recoverable bitumen will be left behind in the combustion-swept zone.

Literature Studies

Oxygen ISC has been studied and practiced for many years (but not in bitumen reservoirs). But, there is a lot of work focused on steam+oxygen mixtures. Over a 30 year span, there are 4 relevant studies, as follows:

Steam+$CO_2$—after oxygen reacts in the reservoir, the "working fluid" is a steam+$CO_2$ mixture. In the early 1980's (Balog, Kerr and Pradt, OGJ, 1981), a study of steam+$CO_2$ injection for cyclic steam EOR (CSS) was carried out. The steam+$CO_2$ mix was produced by a WAO boiler, but the mix could also be produced, in situ, by injection of a steam+$O_2$ mix. The mix contained about 9% (v/v) $CO_2$ in steam, equivalent to a steam+$O_2$ mix containing about 12% $O_2$. We used a Calgary simulation consultant (Intercomp) to model Cold Lake CSS. After 3 CSS cycles, the key simulations results were:

- bitumen productivity improved by 35 to 38% compared to steam-only injection
- oil-to-steam ratio (OSR) improved by 49 to 57%
- productivity pre-unit-energy-injected improved by 30 to 37%

Carbon dioxide (non-condensable gas) improved CSS performance by providing gas drive assist in the "puff" part of the CSS cycle. Cold Lake reservoir fluids also absorbed $CO_2$. Carbon dioxide retention (ie sequestration) was considerable—70 MMSCF alter 3 cycles (1.8 MSCF/bbl bitumen produced). This volume (1.8 MSCF/bbl) is greater than $CO_2$ produced in SAGDOX (9) and about ⅔ $CO_2$ produced by SAGDOX (35).

Combustion Tube Tests—("Parametric Study of Steam Assisted Insitu Combustion" R. G. Moore et al, Feb. 23, 1994 (U of C). Now, lets shift forward by 13 years. In the early 1990's a consortium of companies and government studied combustion tube behaviour of steam/oxygen mixes compared to dry and wet ISC. The crude oil (bitumen) and cores were from Primrose. The tests were conducted at U of C's combustion laboratory. Virgin cores and pre-steamed cores were used (pre-steamed cores were to simulate reservoir combustion where the reservoir had been previously swept by steam). Four combustion process types were evaluated:

steam/$O_2$ mixes with $O_2$ at 2, 6 and 12 (v/v) % dry combustion using air conventional wet combustion (small amounts of water)

super-wet combustion (large amounts of water)

The results were presented by a series of graphs, where the type of process was labeled by numbers. This makes interpretation difficult. But, the results/conclusions include the following:

- Super—wet combustion (liquid water injection, with a water/$O_2$ ratio of 10-15 kg/$m^3$) exhibited LTO and was deemed unsuitable for ISC.
- Conventional net combustion, dry ISC (air) and dry ISC ($O_2$) showed good HTO and are suitable for ISC.
- SAGD and oxygen addition showed good oil recovery.
- Oxygen used varied from about 20 to 60 $sm^3/m^3$ or from 110 to 340 SCF/bbl.
- Peak (combustion) temperatures varied from about 550 to 650° C. (1020 to 1200° F.; F4.7, F4.12).
- SAGD and oxygen combustion was almost complete, with ($CO_2$+CO)/(CO) ratios varying at 12 to 14, much better than conventional combustion (6 to 12). This translates to 91.7 to 92.9% of carbon converted to CO2 for SAGD and oxygen, vs 83.3 to 91.7% for conventional combustion.
- Ignition was easy. Steam preheated the core so that auto ignition occurred quickly.
- The SAGD oxygen mixes actually spanned or exceed the water levels of super-wet ISC the difference was that SAGDO and oxygen injected steam, while super-wet ISC injected water.
- Oxygen requirements for SAGD were inversely proportional to $O_2$ levels in steam (not surprising?)
- The SAGD and oxygen test with the lowest oxygen content exhibited some anomalous behaviour.

Although the test results are somewhat difficult to interpret, they are very positive for SAGD and oxygen, as summed up by the following quotes directly from the report:

- "The co-injection of the steam and oxygen appeared to have considerable merit, based on the stability of the combustion process over a wide range of steam/oxygen ratios" [in a separate conversation G. Moore noted that steam/oxygen combustion was the most stable he had ever seen]
- "It [steam+oxygen] offers the possibility of a new method of producing bitumen and heavy oil using the combined injection of steam and oxygen"

SAGD and oxygen Hybrid—Now we'll shift forward by another 15 years. In 2009 U of C published a simulation study of steam/oxygen mixtures for SAGD EOR ("Design of Hybrid Steam—ISC Bitumen Recover Process", Yang and Gates, Nat. Resources Research, Sep. 3, 2009). The simulation study used a modified STARS model, based on Athabasca reservoir operating at 4 MPa (at an over pressure) in a confined/contained model with no "leakage". The steam/$O_2$ injection rate was controlled (in the model) to maintain the target pressure. Steam-oxygen mixtures varied from 0% (normal SAGD) to 80% oxygen. The results/observations of the results are as follows:

Compared to Long Lake and our SAGDOX proposal herein, the study had 3 "flaws"—firstly, the steam—$O_2$ mixtures were too rich (20, 50, 80% (v/v) oxygen) compared to our range (9.35% $O_2$). At 80% oxygen, about 98% of the energy injected comes from $O_2$ combustion, so the hybrid process is biased (too much) toward ISC($O_2$). Secondly, the reservoir GD chamber was "contained" with no "leaks" or no well to remove non-condensable combustion gases. So, using the process controls built in to the model, $CO_2$ gas build up in the reservoir impairs injectivity and reduces productivity. Productivity plots are not based on equal energy injection. Thirdly, the U of C group focused on an "energy" usage that consisted of steam heat content and energy needed to produce/compress $O_2$ gas. There was no consideration of energy derived from oxygen combustion. There were no plots of productivity for equal energy inputs.

Based on the kinetic combustion model in the simulator (a pseudo-component kinetic model) and other STARS systems, the bitumen and GD chamber exhibited complex behaviour with elements that are normally seen in a ISC process, as follows:

- a combustion-swept zone with no residual bitumen
- a bank of heated bitumen
- a steam-swept zone with residual bitumen at about 25% saturation Carbon dioxide from combustion diluted the steam reducing steam partial pressure, lowering steam T and increasing steam-swept bitumen levels to 25% (compared to "expected" levels of 10-15%).

The average T of the combustion zone was about 450-550° C.—indicating good HTO combustion (combustion tube was 550-650° C.).

Oxygen to bitumen ratios were in the range of 200-240 $sm^3/m^3$ or 1120 to 1350 SCF/bbl.

Water use was cut dramatically compared to SAGD because of the energy released by oxygen consumption and water produced via fuel oxidation in-situ.

Apparent bitumen productivity was 25 to 40% lower than SAGD due to injectivity limitations due to $CO_2$ build up in the contained chamber without leaks or gas removal.

There was no discussions of $CO_2$/CO ratios in the reservoir, although the paper did say (using a kinetic model) that $CO_2$/CO ratios of 8.96 are expected for HTO of coke (90% oxidation of carbon to $CO_2$). (Combustion tube tests predict 92 to 93% conversion of carbon to $CO_2$).

The group also modelled a WAG-type process, using alternating slugs of steam and oxygen injection. This process showed promise, but if ignition is ever a concern, it is probably not a good idea, in practice.

An "energy"/bitumen plot was presented, with decreasing unit "energy" for SAGD and oxygen vs. increasing energy use for SAGD. This is very misleading since the "energy" used is the energy to produce/compress oxygen+the energy in steam. It does not include the combustion energy released to the reservoir The SI-ISC process—(SAGD-initiated insitu combustion) is currently (2010) under development by ARC (the AACI program) and supported by Nexen. The idea is to use a traditional SAGD geometry to start up (transition) to ISC. The proposed process retains the SAGD production well to produce bitumen. In one version, a new VT well is drilled at the toe of the SAGD well pair to inject air and the SAGD injection well is converted to a combustion gas production well. In another version, the VT well at the SAGD toe is used to produce combustion gases and the SAGD injector is converted to an air injector. Nexen has use rights for the SI-ISC process.

Although the process may appear to be similar to SAGDOX, we have the following distinguishing features:

the use of oxygen (not air) is not contemplated the simultaneous injection of steam+oxygen (or air) is not contemplated no synergies between air/oxygen and steam are contemplated The above demonstrates that people are considering both steam EOR (SAGD) and ISC for bitumen. The benefits for ISC are compelling, particularly for an end-of-run process.

Literature Summary

There is a paucity of R+D in this area. Only 4 studies are noted herein over a 30 year period.

But, use of oxygen in ISC has been considered for many years, going back to the 1960's (ie 50 years) the risk of LTO and injectivity difficulty into bitumen reservoirs has deterred many.

Few have contemplated the use of $O_2$/steam mixtures.

There have been several field tests of dry ISC using oxygen.

The U of C combustion tests (1994) show superior combustion properties for steam+$O_2$ compared to dry ISC or wet ISC processes. Combustion ignition, stability. Good bitumen recovery.

The steam+$CO_2$ CSS simulation shows some benefits for $CO_2$ (combustion product gas) and the prospects for some $CO_2$ sequestration.

The U of C simulation study (2009) shows it is possible to model SAGDOX processes, and we can expect complex behaviour in our GD chamber.

The AACI tests (2010) indicate renewed interest in ISC.

It is therefore a primary object of the invention to provide a SAGDOX process wherein oxygen and steam are injected separately into a bitumen reservoir.

It is a further object of the invention to provide at least on well to vent produced gases from the reservoir to control reservoir pressures.

It is yet a further object of the invention to provide extended production wells extending a distance of greater than 1000 meters.

It is yet a further object of the invention to provide extended production wells extending a distance of greater than 500 meters.

It is yet a further object of the invention to provide oxygen at an amount of substantially 35% (v/v) and corresponding steam levels at 65%.

It is yet a further object of the invention to provide oxygen and steam from a local cogeneration and air separation unit proximate a SAGDOX process.

Further and other objects of the invention will be apparent to one skilled in the art when considering the following summary of the invention and the more detailed description of the preferred embodiments illustrated herein.

SUMMARY OF THE INVENTION

SAGDOX is a bitumen EOR process using a geometry similar to SAGD, whereby a mixture of steam and oxygen is injected into a bitumen reservoir, as a source of energy (heat). The reservoir is preheated with steam—either by conducting a SAGD process or by steam circulation—until communication is established between wells (a few months to a few years). Then, oxygen/steam mixtures are introduced. Steam provides energy by condensing (latent heat) or by direct heat transfer. Oxygen provides energy by combustion of residual bitumen in the steam-swept zone. The residual bitumen is heated by hot combustion gases, stripped of light ends (fractionated) and pyrolysed to produce a residual "coke" that is the actual fuel consumed by combustion.

A gas chamber is formed containing injected gases, gases that are the product of combustion, refluxed steam and vaporized connate water. Like SAGD, heated bitumen drains by gravity to the lower horizontal well (producer).

According to a primary aspect of the invention there is provided a method for the recovery of hydrocarbons from a subterranean hydrocarbon deposit comprising:

Defining a target reservoir in said deposit;

Providing at least one substantially horizontal steam injection well into said reservoir, preferably having a length beyond 1000 meters;

Providing at least one oxygen injection well into said reservoir;

Providing at least one production well from said reservoir, preferably having a length in excess of 1000 meters;

a) injecting into a portion of said reservoir proximate said at least one oxygen injection well an oxygen-containing gas to effect oxidation of said hydrocarbons adjacent said injection well, and create a combustion front therein, preferably introduced into a steam swept zone, b) injecting into a portion of said reservoir proximate said at least one steam injection well an effective amount of steam to further reduce the viscosity of said hydrocarbon deposit to flow to said production well, preferably wherein the ratio of the oxygen in said oxygen-containing gas to the water in said steam is in the range of about 200 to about 800 SCF of oxygen per barrel of water, and having an $O_2$ concentration in SAGDOX mix of a 5 to 50% (v/v) range.

c) continuing to separately inject sufficient amounts of oxygen and steam into said reservoir to maintain oxidation and heating of said hydrocarbons in the reservoir, d) displacing said hydrocarbons towards said production well, e) producing said hydrocarbons from said production well f) removing, as necessary, non-condensable gases produced by combustion in the reservoir, to control the reservoir pressure.

In a preferred embodiment said portion of said reservoir into which oxygen and steam are separately injected are generally at opposite ends of said reservoir.

In another embodiment said portion of said reservoir into which said oxygen and steam are separately injected are in an area generally above said production well of said reservoir.

Preferably said $O_2$-containing gas is in the range of 95% to 97% oxygen. Alternatively said $O_2$-containing gas is substantially pure $O_2$.

In one embodiment said oxygen to steam ratio is about 500 SCF of oxygen per barrel of water. The preferred SAGDOX mixture is 35% (v/v) oxygen and 65% steam.

Preferably as a result of oxygen injection, the volume rates of steam use are cut by substantially 76% while still providing with the oxygen the same amount of energy as steam alone and resulting in smaller steam carrying pipe sizes than a steam injection process alone enabling longer pipe runs.

In another embodiment the oxygen injection well is 1 to 4 meters above the toe area of the steam injection well, proximate the end of the reservoir and preferably about 5-20 m in from the end thereof.

According to yet another aspect of the invention there is provided a method of conversion of a (in one embodiment a substantially depleted) SAGD process reservoir to a SAGDOX process reservoir by the addition of oxygen injection according to the methods outlined above herein. Preferably the oxygen is injected into or adjacent to a steam swept zone.

In a preferred embodiment steam and oxygen are supplied from the operation of an adjacent local integrated cogeneration and air separation unit as setout herein in great detail below.

Preferably when converting a SAGD process to SAGDOX packer(s) are used to isolate a portion of the injector well and simultaneously inject steam and oxygen (FIG. 2(1)). (swellable and mechanical downhole packers). The conversion uses the toe of the steam injector for oxygen injection to segregate $O_2$ and steam to minimize corrosion.

In another embodiment the conversion utilizes a packer(s) to isolate part of the injector well to remove produced gases (FIG. 2(4)).

In preferred and alternative embodiments of the invention the method includes properties of SAGDOX injection gases as set out in the table that follows:

| | SAGDOX (0) | SAGDOX (9) | SAGDOX (35) | SAGDOX (50) | SAGDOX (75) | SAGDOX (100) |
|---|---|---|---|---|---|---|
| % (v/v) oxygen | 0 | 9 | 35 | 50 | 75 | 100 |
| % heat from $O_2$ | 0 | 50.0 | 84.5 | 91.0 | 96.8 | 100.0 |
| BTU/SCF mix | 47.4 | 86.3 | 198.8 | 263.7 | 371.9 | 480.0 |
| MSCF/MMBTU | 21.1 | 11.6 | 5.0 | 3.8 | 2.7 | 2.1 |
| MSCF $O_2$/MMBTU | 0.0 | 1.0 | 1.8 | 1.9 | 2.0 | 2.1 |
| MSCF steam/MMBTU | 21.1 | 10.6 | 3.3 | 1.9 | 0.7 | 0.0 |

Where:
Steam heating value = 1000 BTU/lb
$O_2$ heating value (combustion) = 480 BTU/SCF
SAGDOX (0) = pure steam (ie SAGD)
SAGDOX (100) = pure oxygen Preferably the gas mixture of steam and oxygen contains 5 to 50 (v/v) % oxygen.

According to yet another aspect of the invention there is provided a process to recover bitumen comprising the following steps:

- injection of steam/oxygen mix in the rang of 5 to 50% $O_2$ in the mix, into a bitumen reservoir
- production of hot bitumen+water using a horizontal production well
- Production/removal of non-condensable combustion gases to control reservoir pressure In one embodiment the process uses separate wells to inject steam and oxygen.

It is preferred that a separate well(s) is used to remove non condensable combustion gases to control reservoir pressure.

In an alternative embodiment the reservoir can sequester the gases (ie a leaky reservoir) and therefore a removal well is not needed.

In yet another embodiment of said process the produced gases are captured and sequestered in a separate (off-site) reservoir.

In yet another embodiment of said process the produced gases are captured and sequestered in a separate (on-site) reservoir.

In yet another embodiment said process is carried out with an $O_2$ range of 10 to 40%.

In yet another embodiment said process is carried out with an $O_2$ range of 30 to 40%.

According to yet another aspect of the many embodiments of the invention described herein there is provided a process to produce steam and oxygen (suitable for SAGDOX EOR), each available in separate streams, comprising:

a) a cogeneration plant produces electricity and steam b) the electricity is used to operate an air separation unit, ASU c) the ASU produces the oxygen gas.

the steam and oxygen streams being provided to an adjacent local SAGDOX process.

Preferably any resulting steam/oxygen mixture is in the 20 to 60% (v/v) oxygen range.

Alternatively any resulting steam/oxygen mixture is in the 20-40% oxygen range.

In another embodiment of the process steam production is augmented by separate steam generation to produce a 4-40% oxygen range.

For SAGDOX one should address the following issues:

- to keep steam and oxygen separate until they can mix in the reservoir, otherwise corrosion (particularly of carbon steel) will be rapid, damaging and costly
- to start SAGDOX oxygen injection in a steam swept zone
- to separate injection control (eg. Separate wells) for steam and oxygen
- to define an injection strategy to ensure good contact with the reservoir (i.e. good conformance)
- depending on the reservoir, to separate well(s) to remove non-condensable gas products of combustion. Otherwise back pressure can build up and limit injectivity.

Advantages of Invention(s)

All well patterns address all of the issues presented above.

TECHNICAL DESCRIPTION OF INVENTION

Introduction

SAGDOX is a bitumen EOR process that can be added on to SAGD and uses mixtures of steam and oxygen. Steam provides heat directly, oxygen adds heat by combusting residual bitumen in a steam-swept zone.

While it is possible to start a SAGD project using steam only and then implement SAGDOX by adding oxygen to the steam, this is not preferable because of high corrosion rates in a saturated steam and oxygen system, particularly using carbon steel pipes. The preferred strategy is to separately isolate steam and oxygen injection and allow mixing to occur in the reservoir. The separation can be accomplished by packers (swellable and mechanical downhole packers) or by using separate injector wells.

The preferred SAGDOX mixture is 35% (v/v) oxygen and 65% steam.

Injector Volumes

Lets define SAGDOX (Z) where Z=% (v/v) oxygen in the steam oxygen mixture.

Table 1 presents properties of SAGDOX injection gases. Some of the features of the gas mixtures are as follows:

As the percent of oxygen in the mix increases, the total volume to inject a fixed amount of energy drops by up to a factor of 10.

For our preferred mix (SAGDOX (35)), to inject the same amount of energy as steam, our volume rates are cut by 76%. We can expect smaller pipe sizes than a SAGD project.

Compared to SAGD steam for SAGDOX(35) our oxygen injection rate is 8.5% of the volume rate. Our $O_2$ injector (and produced gas) well can be very small.

Preferred Well Configuration

Figure 1:
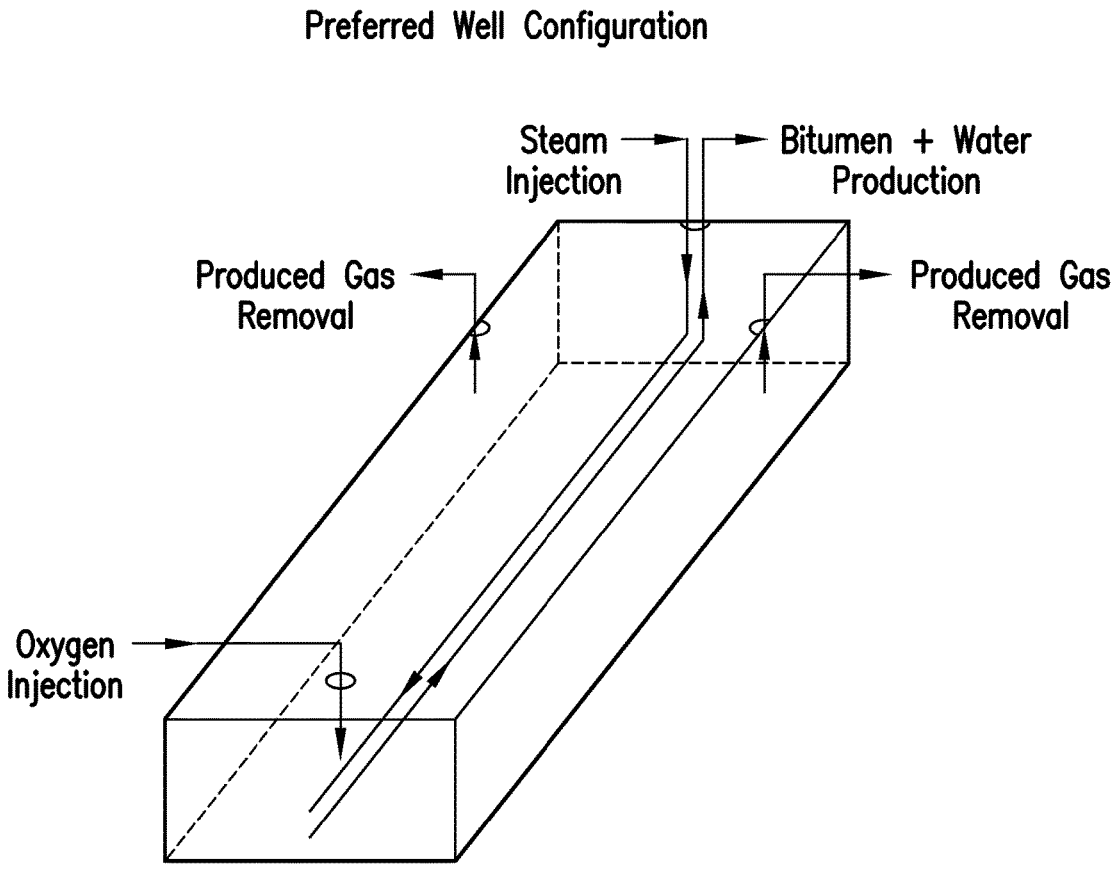
FIG. 1 is a sketch of the preferred well configuration for a SAGDOX Geometry process added on to a SAGD process.

FIG. 1 shows the preferred well configuration for SAGDOX added-on to SAGD. The following features are notable:

The SAGD well pair is conventional—parallel horizontal wells with length of 400-1000 m and separation of 4-6 m. The lower horizontal well is about 2-8 m above the bottom of the reservoir. The upper well is a steam injector. The lower horizontal is the bitumen (+water) producer.

The SAGDOX oxygen injector is above the toe area of the steam injector (1-4 m). The well is not at the end of the pattern (about 5-20 m in from the end).

Two produced gas removal wells are on the pattern boundaries (i.e. only 1 net well) toward the heel area of the SAGD well pair. The wells are completed near the top of the reservoir (1-10 m) below the ceiling.

This configuration enables the following:

Separate control of $O_2$/steam injection

Oxygen injection into the steam-swept area

Removal of (cool) non condensable gases

2(net) new wells (small vertical wells) compared with SAGD

If the reservoir is "leaky", with enough capacity to sequester non-condensable gases produced by combustion, we may not need produced gas removal wells or we can reduce the number of produced gas removal wells.

Other Configurations

Figure 2:
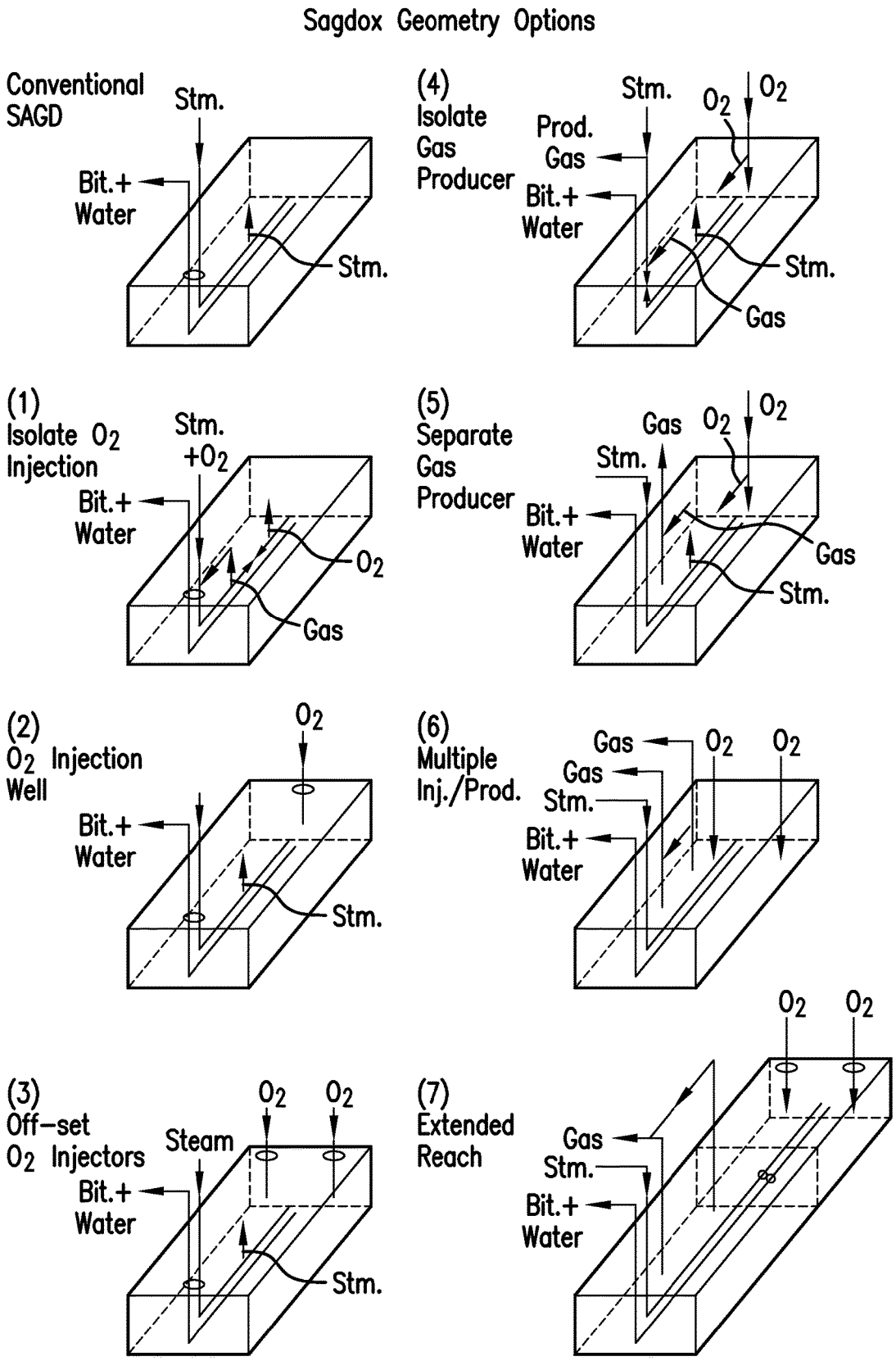
FIG. 2 illustrates various alternative options for configuration of SAGDOX wells.

Of course, our preferred SAGDOX well configuration is not the only way to implement SAGDOX. FIG. 2 shows some other possibilities, including the following:

Using a packer(s) we can isolate a portion of our injector well and simultaneously inject steam and oxygen (FIG. 2(1)). (swellable and mechanical downhole packers) If we can use the toe of the steam injector for oxygen injection we can segregate $O_2$ and steam to minimize corrosion. Even with some corrosion, we are willing to sacrifice the toe of the injector. Because steam demands for SAGDOX are much less than SAGD (Table 1), there is plenty of "room" to segregate $O_2$ and steam in the SAGD producer.

Using a packer(s) we can similarly isolate part of the injector well to remove produced gases (FIG. 2(4)).

We can install multiple oxygen injectors, to improve conformance and allow more control (FIG. 2(3)).

Similarly, we can install multiple produced gas removal wells, to improve conformance and control (FIG. 2(6).

Extended Reach Wells

FIG. 2(7) shows how SAGDOX can improve SAGD. Because liquid volumes in the production well are reduced for SAGDOX compared to SAGD we are no longer limited to a horizontal well pair length of about 1000 m. Table 2 shows that we can expect, for the same bitumen production, the produced volume rates for SAGDOX (35) in the lower horizontal well will be about 28% of the volume rate for SAGD. So with reduced hydraulic limits on well length we can extend SAGD wells beyond the 1000 m limit.

This may have to be drilled initially (not as a SAGD add-on). The extended-reach version of SAGDOX can: (c/w SAGD)

Increase productivity

Increase recovery

Decrease number of wells needed to exploit resource

What Aspects of Invention can be Altered and Still Accomplish Goals?

Well positions, within limits stated 1 well-multiple wells (better control)

$O_2$ concentration in SAGDOX mix (5 to 50% (v/v) range)

Pressure of reservoir

TABLE 1

Properties of SAGDOX Injection Gases

| | SAGDOX (0) | SAGDOX (9) | SAGDOX (35) | SAGDOX (50) | SAGDOX (75) | SAGDOX (100) |
|---|---|---|---|---|---|---|
| % (v/v) oxygen | 0 | 9 | 35 | 50 | 75 | 100 |
| % heat from $O_2$ | 0 | 50.0 | 84.5 | 91.0 | 96.8 | 100.0 |
| BTU/SCF mix | 47.4 | 86.3 | 198.8 | 263.7 | 371.9 | 480.0 |
| MSCF/MMBTU | 21.1 | 11.6 | 5.0 | 3.8 | 2.7 | 2.1 |

TABLE 1-continued

| Properties of SAGDOX Injection Gases | | | | | | |
|---|---|---|---|---|---|---|
| | SAGDOX (0) | SAGDOX (9) | SAGDOX (35) | SAGDOX (50) | SAGDOX (75) | SAGDOX (100) |
| MSCF $O_2$/MMBTU | 0.0 | 1.0 | 1.8 | 1.9 | 2.0 | 2.1 |
| MSCF steam/MMBTU | 21.1 | 10.6 | 3.3 | 1.9 | 0.7 | 0.0 |

Where:
Steam heating value = 1000 BTU/lb
$O_2$ heating value (combustion) = 480 BTU/SCF
SAGDOX (0) = pure steam (ie SAGD)
SAGDOX (100) = pure oxygen

TABLE 2

| SAGDOX production well volumes | | | | |
|---|---|---|---|---|
| | SAGDOX (0) | SAGDOX (9) | SAGDOX (35) | SAGDOX (100) |
| Bitumen (bbls) | 1 | 1 | 1 | 1 |
| produced water (bbls) | 3.37 | 1.80 | .71 | 0 |
| connate water (bbls) | 0 | 0.31 | .31 | .31 |

TABLE 2-continued

| SAGDOX production well volumes | | | | |
|---|---|---|---|---|
| | SAGDOX (0) | SAGDOX (9) | SAGDOX (35) | SAGDOX (100) |
| comb. water (bbls) | 0 | 0.09 | .19 | .27 |
| Total (bbls) | 4.37 | 3.20 | 1.21 | 0.58 |

Assumes:
80% original bitumen saturation
All connate water is produced in SAGDOX
All combustion water is produced in SAGDOX
Nexen case studies

| SAGDOX Reservoir Steam use | | | | | | |
|---|---|---|---|---|---|---|
| | SAGDOX (0) | SAGDOX (9) | SAGDOX (35) | SAGDOX (50) | SAGDOX (75) | SAGDOX (100) |
| Avg. ETOR | 1.180 | 1.230 | 1.387 | 1.475 | 1.623 | 1.770 |
| $O_2$ (V/V) % of mix | 0 | 9 | 35 | 50 | 75 | 100 |
| (% of heat) | 0 | 50.0 | 84.5 | 91.0 | 96.8 | 100.0 |
| (MCF/bbl) | 0 | 1.281 | 2.442 | 2.796 | 3.273 | 3.688 |
| ETOR (steam) | 1.18 | 0.615 | 0.215 | 0.133 | 0.052 | 0.000 |
| ETOR ($O_2$) | 0 | 0.615 | 1.172 | 1.342 | 1.571 | 1.770 |
| Steam use (bbl/bbl) | | | | | | |
| Steam inj. | 2.36 | 1.230 | 0.430 | 0.266 | 0.104 | 0.0 |
| Connate steam | 0 | 0.330 | 0.330 | 0.330 | 0.330 | 0.330 |
| Comb steam | 0 | 0.024 | 0.046 | 0.053 | 0.062 | 0.070 |
| Reflux steam | 0 | 0.776 | 1.554 | 1.711 | 1.864 | 1.960 |
| Totals | 2.36 | 2.36 | 2.36 | 2.36 | 2.36 | 2.36 |
| Reflux % | 0 | 33 | 66 | 73 | 79 | 83 |

Where:
ETOR = MMBTU/bbl bitumen
ETOR is prorated between SAGDOX (0) and SAGDOX (100); assuming ETOR for SAGDOX (100) is 150% ETOR SAGDOX (0)
steam use = bbl steam/bbl bitumen
injection "steam" is vapor component, assuming 70% Q at sand face
all connate water in swept zone is assumed vaporized at 80% initial bit. and 20% residual bit. (for $O_2$ cases)
reflux = plug to make steam totals equal, assuming bitumen productivity < total steam and same productivity for all cases
reflux % = reflux as % of total steam used
combustion steam = 14% (v/v) of O2 consumed (see Table 3)
SAGDOX (0) = pure steam (ie SAGD);
SAGDOX (100) = pure $O_2$ (ie ISC ($O_2$))
Oxygen combustion heat = 480 BTU/SCF;
steam = 1000 BTU/lb

TABLE 3

| Integrated ASU: Cogen Energy Use (MMBTU/bbl) | | | |
|---|---|---|---|
| | SAGDOX (9) | SAGDOX (35) | SAGDOX (100) |
| 99.5% $O_2$ purity | | | |
| Steam | 0.683 (73.0) | .239 (52.6) | .148 (40.7) |
| Electricity | 0.065 (7.0) | .124 (27.4) | .142 (39.3) |
| Waste | 0.187 (20.0) | .091 (20.0) | .072 (20.0) |
| Total | 0.935 (100.0) | .454 (100.0) | .362 (100.0) |
| 95-97% $O_2$ purity | | | |
| Steam | 0.683 (74.7) | .239 (57.5) | .148 (46.4) |
| Electricity | 0.049 (5.3) | .093 (22.5) | .107 (33.5) |
| Waste | 0.183 (20.0) | .083 (20.0) | .064 (20.0) |
| Total | 0.915 (100.0) | .415 (100.0) | .318 (100.0) |

Where:
(1) ETOR values from Table 2
(2) see text for assumptions
(3) lower purity $O_2$ uses 25% less electricity

TABLE 4

| Energy Efficiencies (%) | | | | |
|---|---|---|---|---|
| | SAGD | SAGDOX (9) | SAGDOX (35) | SAGDOX (100) |
| 99.5% oxygen | | | | |
| Separate delivery | 73.8 | 84.4 | 91.5 | 92.7 |
| Integ ASU:Cogen | — | 84.4 | 92.4 | 94.0 |
| 95-97% oxygen | | | | |
| Separate delivery | 83.8 | 85.4 | 92.4 | 93.8 |
| Integ ASU:Cogen | — | 84.5 | 93.1 | 94.7 |

Where:
(1) heat value of bitumen = 6 MMBTU/bbl
(2) see text for energy definition
(3) separate delivery case gas boiler 85% + electricity at 55% comb. cycle Insitu Combustion Chemistry $CH._5$=reduced formula for "coke" that is combusted. Ignores trace components (eg S, N . . . ). Doesn't imply molecular structure, only ratio of H/C in large molecules Best guess of net "reservoir oxidation chemistry"

Oxidation of combustion front (assumes 10% carbon goes to CO)=$CH_{0.5}+1.075O_2 \rightarrow 0.9CO_2+0.1CO+0.25H_2O+HEAT$ Water gas shift, in reservoir:

$$CO+0.1H_2O \rightarrow 0.1CO_2+0.1H_2$$

Net reaction stoichiometry:

$$CH_{0.5}+1.075O_2 \rightarrow 1.0CO_2+0.1H_2+0.15H_2O$$

Where:

(1) non-condensable gas make ($CO_2+H_2$)=102% of Oxygen volume
(2) combustion water make=14% of oxygen volume
(3) hydrogen make=9.3% of oxygen volume
(4) produced gas composition (v/v) %

| | Wet | dry |
|---|---|---|
| $CO_2$ | 80.0 | 90.9 |
| $H_2$ | 8.0 | 9.1 |
| $H_2O$ | 12.0 | — |
| Totals | 100.0 | 100.0 |

Heat release=480 BTU/SCF $O_2$

Table 3 shows the efficiencies for various SAGDOX mixtures using the assumptions of Table 2. The following points are evident:

SAGDOX is more efficient than SAGD

The efficiency improvement increases with increasing oxygen content in SAGDOX mixtures.

For SAGD the energy loss is 26%. This loss for SAGDOX is 16 to 6% depending on oxygen content—an improvement of 10-20% or a factor of 1.6 to 4.3.

If we reduce oxygen purity to say the 95-97% range, energy needed to produce oxygen drops by about 25% and SAGDOX efficiencies increase even more than above (see Table 3)

Oxidation Chemistry

SAGDOX creates some energy in a reservoir by combustion. The "coke" that is prepared by hot combustion gases fractionating and polymerizing residual bitumen, can be represented by a reduced formula of $CH._5$. This ignores trace components (S, N, O . . . etc.) and it doesn't imply a molecular structure, only that the "coke" has a H/C atomic ratio of 0.5. Let's assume CO in the product gases is about 10% of the carbon combusted Water-gas-shift reactions, occur in the reservoir $$CO+H_2O \rightarrow CO_2+H_2+HEAT$$

This reaction is favored by lower T (lower than combustion T) and high concentrations of steam (ie SAGDOX). The heat release is small compared to combustion.

Then our net combustion stoichimetry is as follows:

| | |
|---|---|
| Combustion: | $CH_{0.5} + 1.075O_2 \rightarrow 0.9CO_2 + 0.1CO + .25H_2O + HEAT$ |
| Shift: | $.1CO + .1H_2O \rightarrow .1CO_2 + .1H_2 + HEAT$ |
| Net: | $CH._5 + 1.075O_2 \rightarrow CO_2 + .1H_2 + .15H_2O + HEAT$ |

Features are as follows:

Heat Release=480 BTU/SCF $O_2$

Non-condensable gas make=102% of oxygen used (v/v)

Combustion water make=14% of oxygen used (v/v) (net)

hydrogen gas make=9.3% of oxygen used produced gas composition (v/v %)=

| | Wet | Dry |
|---|---|---|
| $CO_2$ | 80.0 | 90.9 |
| $H_2$ | 8.0 | 9.1 |
| $H_2O$ | 12.0 | — |
| Total | 100.0 | 100.0 |

Combustion temperature is controlled by "coke" content. Typically combustion T is between about 400 and 650° C. for HTO reactions.

The Importance of Steam

For SAGD heat transfer is dominated by steam. For SAGDOX we add heat transfer from hot combustion gas. Compared to hot non-condensable gases, steam has 2 significant advantages:

Including latent heat when steam condenses, a fixed volume of steam will deliver more than twice the amount of heat available from the same volume of hot combustion gases When steam condenses, it creates a transient low pressure zone that draws in more steam—ie a heat pump without the plumbing For SAGDOX and SAGD we expect stream use/creation to be a dominant factor for productivity.

Steam Use in SAGDOX

As we add oxygen to steam we expect less steam in the reservoir, as more and more of the heat injection comes from combustion. So, if everything else was equal, we would expect decreasing productivity or increasing ETOR for constant productivity. But, oxidation processes offer 3 ameliorating factors:

Some extra steam is produced as a product of combustion

Some extra steam is produced by vaporizing connate water in combustion swept zones Some extra steam is produced when hot gases or hot bitumen vaporizes condensed water (i.e. reflux)

So we expect, if SAGDOX is to have the same productivity as SAGD, to inject more energy than SAGD (to compensate for reduced steam inventory) and to have significant reflux of steam, accounting for extra steam sources. Table 2 shows one such balance—but there may be several and each reservoir may be different.

SAG Performance

Figure 3:
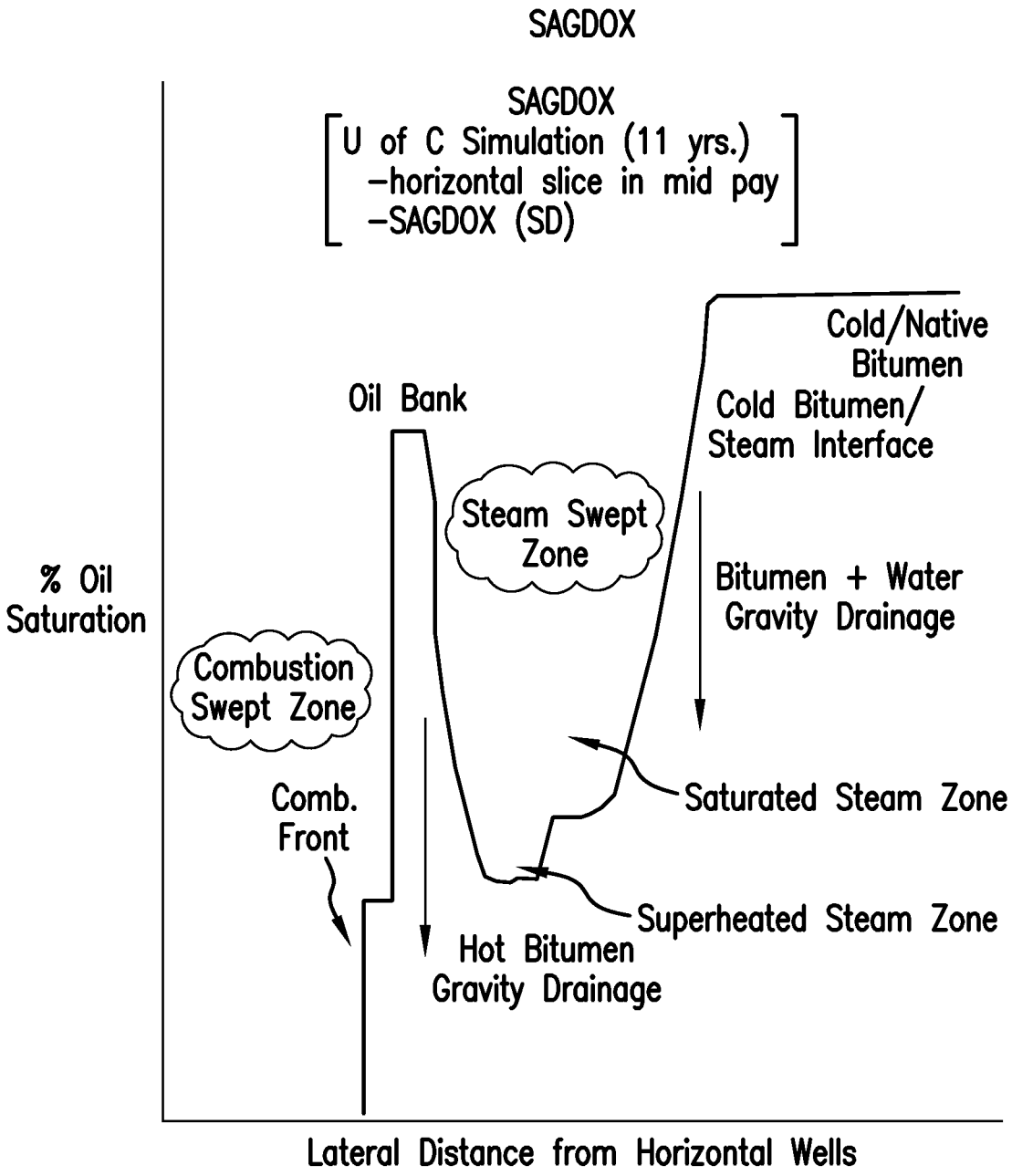
FIG. 3 illustrates a horizontal slice in mid play for a SAGDOX process based on a University of Calgary Simulation study.
Figure 3A:
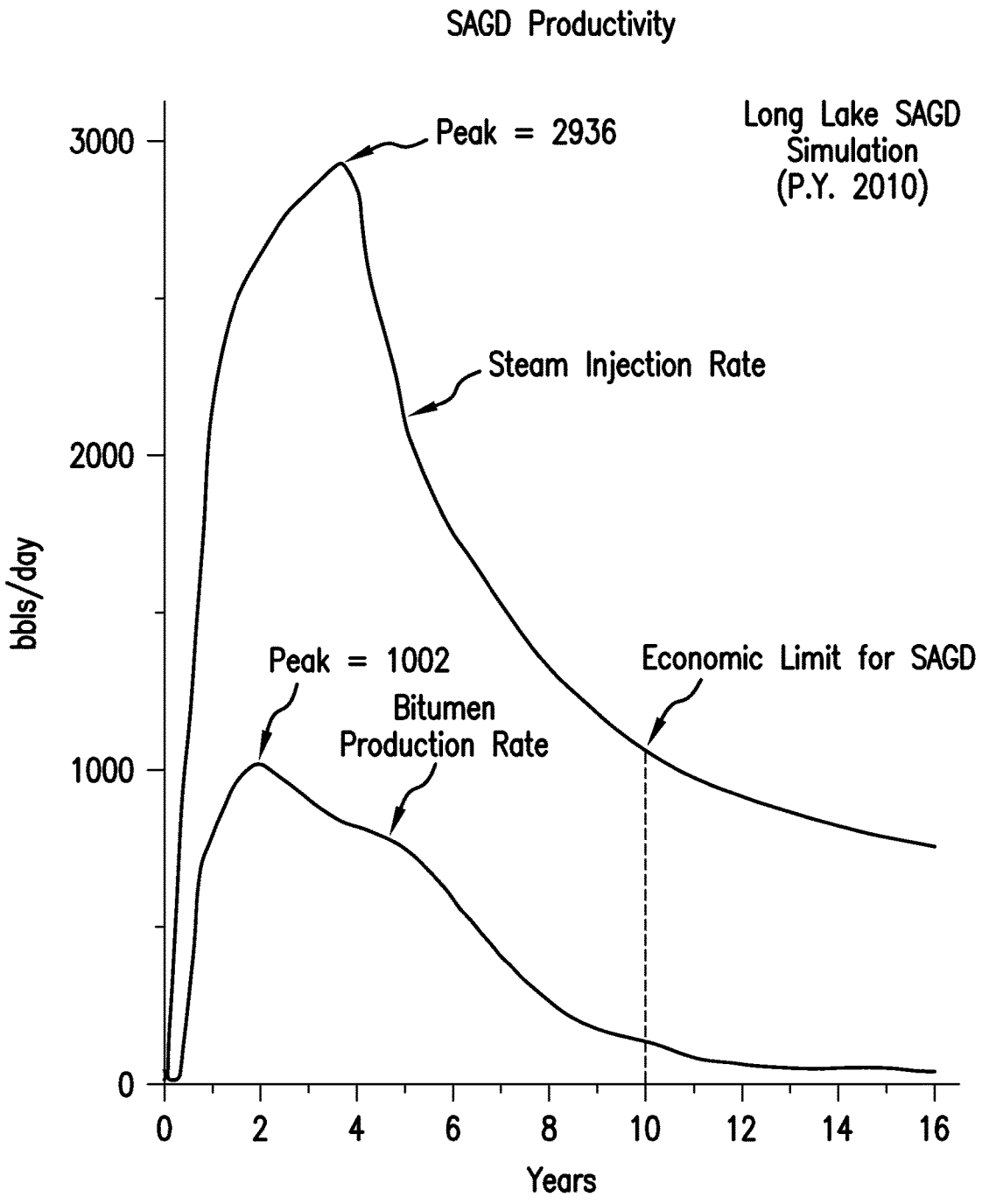
FIG. 3A is productivity chart for a SAGD process where steam alone is injected into the well.

With some assumptions, we can compare SAGDOX performance with SAGD. Nexen has simulated SAGD under the following assumptions:

a homogenous sandstone bitumen reservoir generic properties for LLK bitumen 25 m, clean, homogeneous pay zone 800 m, SAGD well pair at 100 m spacing, with 5 m separation between steam injector and bitumen/water producer 10° C. sub cool for production control 2 MPa pressure for injection control 4 mos. start-up period, using steam circulation discretized well-bore model The simulation production results are shown in FIG. 3.5. The economic limit is taken at SOR=9.5, at the end of year 10. The results for SAGD can be summarized as follows:

bitumen recovery=333.6 $km^3$=2.099 MMbbl average bitumen production=575 bbl/d peak bitumen rate (end yr. 2)=159.2 $m^3$/d=1002 bbl/d steam used=1124.9 $km^3$=7.078 MMbbl=$2.477\times10^{12}$ BTU average steam rate=1939 bbl/d peak steam (end yr. 4)=456.7 $m^3$/d=2874 bbl/d average SOR=3.37 (average ETOR=1.180)

recovery factor=63.4% OBIP

OBP in pattern=3.31 MMbbl

We will use this simulation as the basis for SAGDOX production comparisons.

SAGDOX Performance

Mechanisms

SAGDOX has 2 separate sources of reservoir heat delivery—steam condensation, and oxygen combustion of residual bitumen. Before we develop comparisons to SAGD, lets look at a simulation of SAGD so we can understand the mechanisms that are important. FIG. 3 presents the results of a simulation of a SAGDOX process using a combustion kinetic model and a modified STARS simulator. The plot is for a "mature" process after several years of operation, taking a horizontal slice half-way up the pay zone and half-way down the length of the horizontal well pair. The plot is for bitumen saturation as a function of lateral distance from the vertical plane of the horizontal well pair. Looking at the plot, we see the following process features, as we move outward from the central plane:

A combustion-swept zone with zero residual bitumen and zero residual water;

A combustion front, indicated by a share increase in bitumen saturation;

A bank of hot bitumen, partially fractionated (stripped of light ends) and partially upgraded by pyrolysis from hot combustion gases. The bitumen bank temperatures are higher than saturated steam, so bitumen draining is hot and can reflux steam as it meets condensed water below the plane;

A steam swept zone made up of 2 parts—superheated zone with no steam condensate and a saturated-steam zone with condensed water;

The cold-bitumen: saturated-steam interface where steam condenses to heat bitumen;

Bitumen drains downward (and inward) from 2 areas—the hot bitumen bank near the combustion front and heated bitumen, near the cold bitumen interface. (Most of the bitumen produced comes from the later zone);

Water also drains from 2 areas—the saturated steam zone and near the bitumen interface. (Most of the water drained comes from the later zone).

Kinetics/Productivity

Let's first look at SAGD (steam gravity drainage). The process is complex with many steps, as follows:

steam is injected at the sand face;

steam enters the reservoir, in a steam-swept zone, at (near) saturated steam temperature;

as the steam moves through the reservoir heat losses reduce steam quality, but T is relatively constant;

when steam reaches the cold bitumen interface, it condenses (to water) and releases its latent heat;

the latent heat is conducted in the interface and heats the matrix rock and the reservoir fluids (bitumen and connate water);

the heated bitumen drains downward and inward to the horizontal production well, about 5 m underneath the steam injector well—(drainage distances are ≤50 m);

condensed water also drains to the same well;

the bitumen/water mixture is pumped/conveyed to the surface.

Productivity (rate of bitumen production) is determined by the cumulative rate of all of these steps. The slowest step (rate-limiting step) is usually considered to be bitumen drainage to the production well (step (6)). Drainage rates are dependent on the drainage distance, the matrix permeability and the viscosity of the heated bitumen. Bitumen viscosity is the key variable and it is a strong function of temperature.

SAGDOX has a similar geometry to SAGD, but the process is more complex. The mechanisms for steam (SAGD) EOR are still active, but the combustion component adds the following steps:

ignition occurs at the combustion front, where oxygen reacts with residual fuel (coke);

hot combustion gases fractionate residual bitumen, in (or near to) the steam-swept zone, and pyrolyse bitumen to prepare residual fuel (coke) for combustion;

connate water, in the steam-swept zone, is vaporized to steam;

hot combustion gases superheat steam;

hot bitumen and hot combustion gases vaporize (reflux) condensed steam;

at the cold bitumen interface, some heat is transferred directly from hot combustion gases to cold bitumen, connate water and matrix rock;

a hot bitumen bank is formed downstream of the combustion front;

This hot bitumen drains downward and inward to the horizontal production well;

Temperatures are greater than saturated steam temperatures;

Heat exchange (reflux) from the hot bitumen in (G) and (H) to condensed water draining to the production well.

So SAGDOX has all the mechanisms/steps of SAGD plus the additional steps arising from combustion processes. It is not obvious, for productivity and kinetics, what is the rate-limiting step for SAGDOX.

Preferred Range of Oxygen Content in SAGDOX Gases

Below about 5% oxygen in a steam+oxygen mixture combustion may become unstable and it becomes difficult to keep oxygen flux rates to sustain HTO. It also becomes difficult to vaporize and mobilize all connate water.

Above about 50% oxygen in steam, the reflux rates to sustain productivity are more than 70% of the total steam. This may be difficult in practice. Also, above this limit the bitumen ("coke") fuel that is consumed starts to be greater than the residual fuel left behind in the steam-swept zone. Also, above this limit it isn't possible to produce steam/electricity mixes from an integrated cogen: ASU for SAGDOX. Compared to SAGD, SAGDOX (50) may have lower recoveries.

So the preferred range is 5 to 50 (v/v) % oxygen in the steam+oxygen mixture injected. If we are more concerned about safety factors, a range of 10 to 40 (v/v) % oxygen, may be preferred.

Based on an economic study the preferred oxygen content is about 35% (v/v) % or a range of 30 to 40% (v/v).

Synergies

A synergy is an "unexpected" benefit. The cumulative benefits of the steam-oxygen mix are more than the benefits of the stand-alone components.

How does Oxygen Help Steam EOR Benefits?

surface steam demand (water use) is directly reduced;

extra steam is created directly in the reservoir by combustion of coke;

heat of combustion vaporizes connate water to increase steam in the reservoir;

heat of combustion results in vaporization of condensed steam (water reflux);

in situ combustion can increase avg. T in the steam/combustion swept zones beyond the saturated steam T limit;

the use of oxygen improves overall energy efficiency;

non-condensable gases produced from combustion insulates the top of the pay zone to reduce energy losses and increases lateral vapour chamber growth rates. This can be beneficial if the reservoir has top water or top gas because SAGDOX steam+oxygen mixes cost less than pure steam for the same energy content, we can extend production beyond the economic limit for steam-only and increase ultimate recovery/reserves if some $CO_2$ is retained in the reservoir or if some $CO_2$ is captured and sequestered off-site, we can reduce $CO_2$ emissions compared to steam only.

How does Steam Help Combustion?

steam pre-heats the reservoir, so oxygen gas will ignite to start combustion (this is now the accepted method for ISC);

in the presence of increased T (400-600° C. range) and a solid rock matrix, steam adds OH and H radicals (ions) to the combustion zone. This improves combustion kinetics (analogy to smokeless flares);

steam added (and created) acts as an efficient heat transfer medium to convey heat from the combustion zone to the cold bitumen interface. This improves EOR kinetics;

Steam stimulates increased combustion completeness, even for lean mixes (ie more $CO_2$ less CO);

Steam stabilizes combustion (HTO is more likely than LTO);

Steam supplies some direct heat.

Energy Efficiency

Lets define EOR energy efficiency as:

$$\left\{\frac{\left(\begin{array}{c}\text{energy produced}\\ \text{in bitumen}\end{array}\right)-\left(\begin{array}{c}\text{energy used, on surface}\\ \text{to produce bitumen}\end{array}\right)}{(\text{energy in produced bitumen})}\right\}\times 100\%$$

For SAGD (SAGDOX (0)), if we assume that the energy content of bitumen (heating valve) is 6MMBTU/bbl, and that the net efficiency of steam production and delivery to the sand face is 75% (85% in a boiler and 10% loss in distribution); then our SAGD efficiency is:

$$\left(\frac{6-ETOR/.75}{6}\right)\times 100\%$$

For our simulation (4.2) our average ETOR is 1.180 MMBTU/bbl and our SAGD efficiency is 73.8%.

For SAGDOX our energy calculation is more complex. The steam component will have a similar factor (ETOR (steam)/0.75), but oxygen will be different. If we assume our oxygen ASU oxygen use is 390 kWh/tonne $O_2$ (for 99.5% pure oxygen) and that electricity if produced on-site from a gas-fired, combined-cycle power plant at 55% efficiency, for every MMBTU of gas used to produce power, oxygen in the reservoir releases 5.191 MMBTU of combustion energy. Using these, our SAGDOX efficiency is:

$$\left\{\left(\frac{6-ETOR\ (\text{Steam})}{0.75}-\frac{ETOR(O_2)}{5.191}\right)\right\}\times 100\%$$

Why is SAGDOX an "Invention"?

To qualify as a true invention the proposal/process/equipment has to be not obvious to one "skilled in the art". SAGDOX meets this criteria for the following reasons:

It is no obvious that there should be limits on preferred oxygen concentration ranges for SAGDOX injection gases. On the low end, the stability of combustion in situ at low oxygen levels in steam has not been widely studied nor reported. On the high end, the idea that steam use or steam inventory is the deciding factor in bitumen productivity, has not been widely proposed nor published. The specific range and rationale has not been claimed by others.

The synergistic benefits of oxygen and stream are no well-known, not obvious and not published (to my knowledge).

The well configurations for SAGDOX are unique. No one else has tried SAGDOX.

The fact that SAGDOX can also result in extended well lengths, has not been appreciated elsewhere.

No one else has proposed/contemplated an integrated Cogen: ASU plant.

Hydrogen gas production has been noted in some ISC projects for heavy/medium oil, but there is no experience in bitumen. Reservoir conditions in SAGDOX should be ideal for hydrogen production.

The advantages of SAGDOX in inhomogeneous reservoirs and leaky reservoirs are intuitive. No field tests have been conducted.

What Aspects of Invention can be Altered and Still Accomplish Object/Goals?

$O_2$ content in mix, within range claimed;

Geometry of well configurations;

Method of supplying steam and oxygen gas;

Purity of oxygen (but no more than ~5% impurities and impurities are "inert");

Length of horizontal wells (up to hydraulic limit).

1.2 Gas Mixture Delivery Invention

SAGDOX is a bitumen EOR process that uses mixtures of steam and oxygen gas in the preferred range of 5 to 50 (v/v) % oxygen in steam. To control corrosion, it is preferable to inject separate streams of oxygen and steam and allow mixing in the reservoir to create the desired mix. We can provide these gases using separate facilities—steam boilers to generate steam and cryogenic air separation units (ASU) to produce oxygen gas. The boilers require a fuel-natural gas is preferred and the ASU requires electricity.

Figure 4:
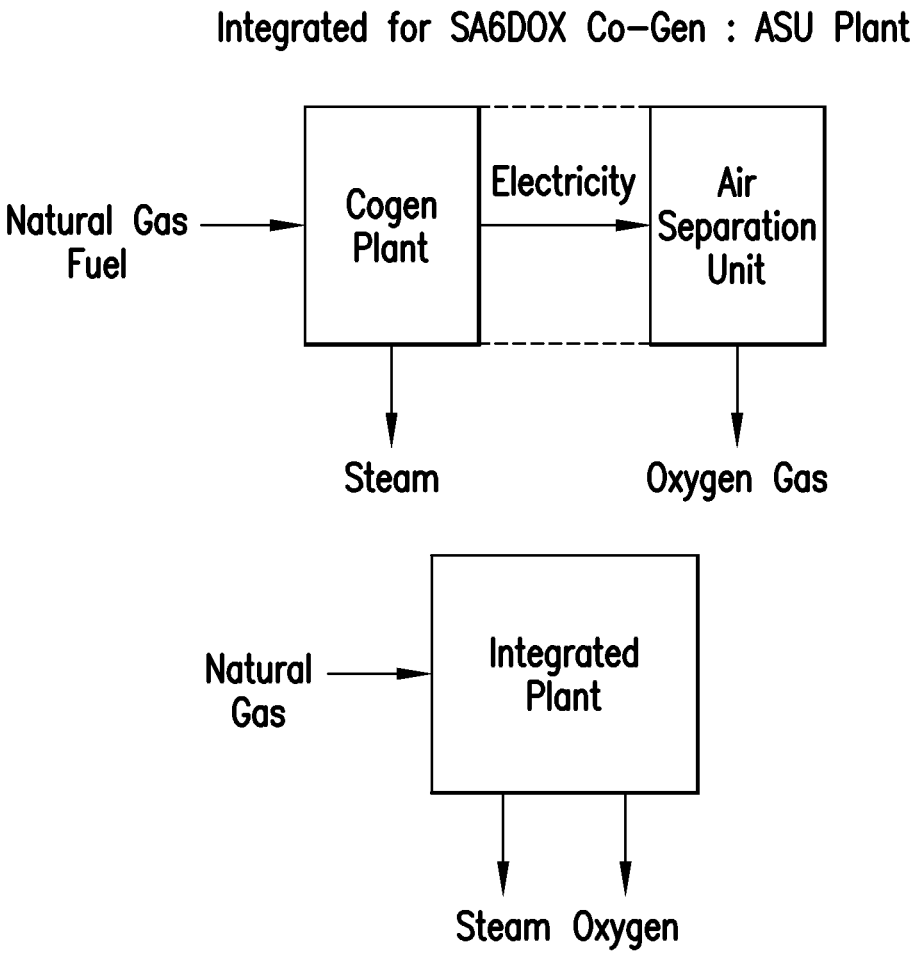
FIG. 4 is a schematic sketch of an integrated cogeneration process for steam and electricity in a SAGDOX operation with an air separation unit

If we integrate steam and oxygen facilities, on site, we can use a cogen plant to produce steam and electricity. We can then dedicate the electricity to the ASU (FIG. 4). Other integration benefits can occur. For example air compression can also be combined, to supply compressed air as a feedstock for the ASU and compressed air for combustion to the gas turbines in the cogen plant.

Figure 5:
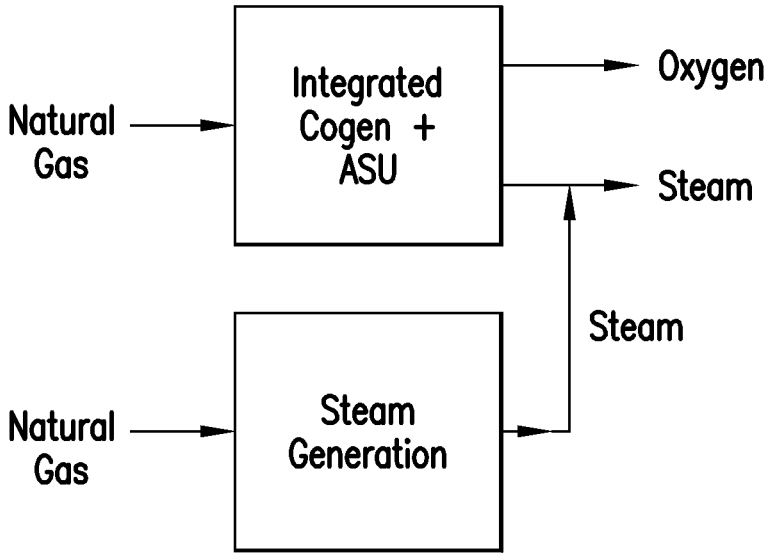
FIG. 5 is in addition to FIG. 4 illustrates the addition of a conventional steam boiler thereto.

On a net basis, the integrated plant would consume natural gas and produce oxygen and steam for SAGDOX. A typical high-efficiency modern gas turbine has efficiencies in the range of 40-45%. On the low-side turbine efficiencies are about 20-25%. As we will show these limits if applied, would limit SAGDOX gas concentrations to about 25-30% oxygen on the low side or 50-55% on the high side. In order to extend the low side to the preferred SAGDOX range we can simply add a conventional steam boiler as shown in FIG. 5.

The advantages of an integrated approach include:

(1) lower capex (2) less energy; higher energy efficiency (3) reduced footprints 1.3 Invention Analysis Lets assume:

(1) cogen plant is a gas-fired gas-turbine generator followed by a heat recovery steam generator (HRSG)

(2) cogen has 20% heat losses (ie 80% efficiency)

(3) E=total ETOR demand, in reservoir (4) x=fraction of E due to oxygen ETOR (oxygen)

(5) (1-x)=fraction of E due to steam ETOR (steam)

(6) 10% distribution losses for steam (7) Two oxygen cases—99.5% purity; 390 kwh/tonne and 95-97% purity; 292.5 kwh/tonne (Z=kwh/tonne $O_2$)

Then at the cogen plant, steam demand=1.111 E (1-x) MMBTU/bbl bit oxygen demand=xE MMBTU in the reservoir from combustion=0.0002717 xEZ MMBTU(e) at the cogen plant.

Table 3 shows an analysis of the above, using ETOR values in Table 2. We have defined energy efficiency as:

$$\left\{\frac{\left(\begin{matrix}\text{energy produced}\\ \text{in bitumen}\end{matrix}\right)-\left(\begin{matrix}\text{energy used on surface to}\\ \text{produce bitumen}\end{matrix}\right)}{\left(\begin{matrix}\text{energy produced}\\ \text{in bitumen}\end{matrix}\right)}\right\}\times 100\%$$

Table 4 compares efficiencies. The following comments are noteworthy.

(1) Surface energy use is less than reservoir energy ETOR, because oxygen delivers much more heat via combustion than it takes to make oxygen.

(2) The integrated system has higher efficiencies than separate delivery for all cases except SAGDOX(9) at 95-97% oxygen purity (We assumed a stand alone steam boiler was 85% efficient c/w cogen at 80%).

2. What can be Changed and Still Accomplish Goals?

(1) SAGDOX gas mix in 5-50% range $O_2$ (2) Reservoir P

Advantages of the Invention

An integrated Cogen:ASU plant to produce separate streams of steam and oxygen gas reduces overall cost of oxygen and steam/capex and opex improves energy efficiency reduces (eliminates) reliance on outside (grid) power reduces surface footprint for on-site generation of steam and oxygen 2.2 SAGD Performance We have simulated a SAGD process in a typical Athabasca reservoir—25 m.net pay, 800 m. SAGD wells separated by 5 m., 2 MPa pressure. This acts as a base case for SAGDOX comparison. The results are shown in FIG. 3.5. Bitumen recovery is 2.099 MM bbls after 10 years, avg. SOR=3.37 (ETOR=1.18), the recovery factor was 63.4% OBIP. [ETOR=MMBTU of energy/bbl bit.]

2.3 SAGDOX Performance

FIG. 3 shows bitumen saturation as a function of distance from the central vertical plane, about half way in the net pay zone, for SAGDOX in a mature project. The simulation was for a generic Athabasca bitumen reservoir using a combustion kinetic model and the STARS simulator. —Looking at the plot we see, as we move outward=

(1) a combustion swept zone with no residual bitumen (2) a combustion front (3) a hot bitumen bank of oil (4) a steam swept zone (5) the cold bitumen interface Bitumen drains both from the bitumen bank and from the cold bitumen front. Water drains from the saturated-steam zone and from the bitumen front.

SAGDOX is a complex process—more complex than SAGD. We are not sure what is the rate-limiting step for SAGDOX, but we believe steam use and steam inventory are key factors. Steam is an ideal fluid to effect heat transfer. Compared to hot combustion gases, steam has 2 big advantages. A fixed volume of steam will deliver a least twice as much heat when it condenses compared to hot combustion gases, and, when steam condenses, it creates a transient low pressure zone that draws in more steam. Steam in a gas chamber acts like a heat pump, to the cold walls, with the plumbing.

Despite lower heat transfer rates than steam, combustion has some decided advantages. Combustion will vaporize connate water, reflux some condensed steam and produce some steam as a product of combustion. These will all add to the steam inventory and aid transfer. But, as the oxygen content, in SAGDOX injection mix, increases the amount of steam injection decreases, for constant energy injection rates. Table 1 shows the properties of steam-oxygen mixtures.

We expect that for SAGD productivity, we will need to inject more energy than SAGD (ie higher ETOR values), increasing as oxygen levels increase. Table 2 shows this for several SAGDOX mixtures.

The preferred range of $O_2$ concentration is between 5 and 50 (v/v) %. Below 5% oxidation may be unstable and there is little extra heat to ensure connate water evaporation and steam reflux. Above 50%, we start to oxidize bitumen that we could otherwise produce and it may be difficult to sustain water reflux rates to maintain productivity.

As many changes therefore may be made to the embodiments of the invention without departing from the scope thereof. It is considered that all matter contained herein be considered illustrative of the invention and not in a limiting sense.

The invention claimed is:

1. A process to produce bitumen from an at least partially depleted steam-swept bitumen-comprising reservoir:

wherein a reservoir in a natural state containing 100% of a native bitumen has been previously subjected to an initial extraction to produce the at least partially depleted steam-swept reservoir by:

installing a steam assisted gravity drainage (SAGD) system within the reservoir, the SAGD system comprising: a production well having a horizontal distal portion and a vertical proximal portion in communication with an extraction pump; and a steam injection well having a horizontal distal portion above the horizontal distal portion of the production well and a vertical proximal portion in communication with a steam source;

operating the SAGD system, by injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well;

the process comprising:

subjecting the at least partially depleted steam-swept reservoir to a secondary extraction comprising:

installing an oxygenatious gas injection well with a gas outlet in the at least partially depleted steam-swept reservoir above the horizontal distal portion of the production well, the gas injection well being separate from the SAGD system and horizontally spaced apart from the SAGD system;

operating the oxygenatious gas injection well by injecting oxygenatious gas through the gas outlet and igniting the bitumen in a combustion zone in the at least partially depleted steam-swept reservoir with the effect that one of: combustion heat energy; oxygenatious gas pressure; steam heat and steam pressure generated from vaporized water within the at least partially depleted steam-swept reservoir; and combustion gas pressure is applied to the bitumen, thereby reducing viscosity of the bitumen and mobilizing the bitumen to flow downward under gravity drainage into the horizontal distal portion of the production well, wherein a volume to volume ratio of oxygenatious gas in the secondary extraction relative to water used to produce steam in the initial extraction is in the range of 5% to 50%.

2. The process according to claim 1 wherein the initial extraction produces an at least partially depleted steam-swept reservoir having between 10-25% residual bitumen of the native bitumen, and wherein the secondary extraction comprises:

heating the residual bitumen with combustion gases in the combustion zone;

stripping light fractions from the residual bitumen;

pyrolyzing the residual bitumen to produce coke;

oxidizing the coke; and producing a combustion swept zone having substantially no recoverable bitumen.

3. The process according to claim 1 wherein the ratio is in the range of 10% to 40%.

4. The process according to claim 1, comprising:

installing a produced gas (PG) extraction well with an inlet within the at least partially depleted steam-swept reservoir, the PG extraction well being separate from the SAGD system and horizontally spaced apart from the SAGD system; and operating the PG extraction well to extract non-condensable gas.

5. The process according to claim 4, comprising:

controlling the formation of the combustion zone by controlling one of: the injection of oxygenatious gas; and the extraction of produced gas.

6. The process according to claim 5, wherein one of: a plurality of oxygenatious gas injection well outlets; and a plurality of PG extraction well inlets, are spaced apart horizontally to control the formation of the combustion zone.

* * * * *